US006345992B1

(12) United States Patent
Cheong et al.

(10) Patent No.: US 6,345,992 B1
(45) Date of Patent: Feb. 12, 2002

(54) ELECTRICAL CONNECTOR FOR MOUNTING ON A PRINTED CIRCUIT BOARD AND INCLUDING A TERMINAL TAIL ALIGNER

(75) Inventors: Mun Fai Cheong; Poh Teck Lim; Ser Kiat Toh, all of Singapore (SG)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/392,709

(22) Filed: Sep. 9, 1999

(30) Foreign Application Priority Data

Sep. 15, 1998 (SG) ..... 9803665

(51) Int. Cl.[7] ..... H01R 12/00
(52) U.S. Cl. ..... 439/83; 439/892
(58) Field of Search ..... 439/83, 892, 79, 439/80

(56) References Cited

U.S. PATENT DOCUMENTS

| | | | | |
|---|---|---|---|---|
| 4,721,472 A | | 1/1988 | Gentry et al. | 439/79 |
| 5,090,927 A | | 2/1992 | McAnany | 439/892 |
| 5,102,353 A | | 4/1992 | Brunker et al. | 439/608 |
| 5,104,326 A | | 4/1992 | Smith et al. | 439/95 |
| 5,269,692 A | * | 12/1993 | Takahashi | 439/74 |
| 5,487,674 A | * | 1/1996 | Guzik et al. | 439/83 |
| 5,658,155 A | | 8/1997 | McFarlane et al. | 439/79 |
| 5,667,411 A | | 9/1997 | O'Sullivan et al. | 439/701 |
| 5,692,912 A | | 12/1997 | Nelson et al. | 439/79 |
| 5,718,592 A | * | 2/1998 | Hosler, Sr. et al. | 439/63 |
| 5,730,630 A | | 3/1998 | Lacourse et al. | 439/876 |
| 5,961,347 A | * | 2/1999 | Hsu | 439/570 |
| 5,919,063 A | * | 7/1999 | Wang | 439/608 |
| 6,019,613 A | * | 2/2000 | Kataoka et al. | 439/83 |

* cited by examiner

*Primary Examiner*—Neil Abrams
*Assistant Examiner*—J. F. Duverne
(74) *Attorney, Agent, or Firm*—Charles S. Cohen

(57) ABSTRACT

An electrical connector 10 is mountable on a surface of a printed circuit board 11. Connector 10 includes an elongated dielectric housing 12 having a central body portion 12*a* with a front mating face 16*a*, a lower face 23 and a plurality of terminal-receiving passages 19 extending therebetween. A plurality of terminals 20 are received in passages 19. Each terminal 20 includes a forward contact portion 21 and a tail portion 22 projecting from a body portion 12*a* of terminal 20 beyond lower face 23 of housing 12. Tail portions 22 include angled sections 22*a* for surface mounting on printed circuit board 11. An elongated tail aligner 32 is fixed to housing 12 spaced from lower face 23 thereof. Tail aligner 32 has a plurality of apertures 34 through which tail portions 22 of terminals 20 extend.

16 Claims, 2 Drawing Sheets

ELECTRICAL CONNECTOR FOR MOUNTING ON A PRINTED CIRCUIT BOARD AND INCLUDING A TERMINAL TAIL ALIGNER

FIELD OF THE INVENTION

This invention generally relates to the art of electrical connectors and, particularly, to an electrical connector for mounting on a surface of a printed circuit board and includes a terminal tail aligning device.

BACKGROUND OF THE INVENTION

A known type of input/output (I/O) electrical connector includes an elongated dielectric housing having a front mating face and a rear face with a plurality of terminal-receiving passages extending therebetween. The faces extend longitudinally between opposite ends of the elongated housing. A plurality of terminals are received in the passages. Each terminal includes a forwardly projecting contact portion and a tail portion projecting rearwardly from the housing beyond the rear face thereof.

Electrical connectors of the character described above often include terminal tail aligning devices. This is particularly true wherein the terminals of the connectors are connected to appropriate circuit traces on a printed circuit board. With the ever-increasing miniaturization and density of electronic circuitry, the tail portions of the terminals tend to be very thin and, therefore, fragile. As a result, it is advantageous to support the tail portions so that they will be properly aligned with plated holes in the printed circuit board. Specifically, the tail aligning devices are mountable on the connector housing and even may be movably mounted thereon. The tail aligning devices have a plurality of apertures through which the tail portions of the terminals extend to maintain the tail portions in proper position and spacing.

One of the problems with connectors of the character described above is that the connector housing often becomes rather thick to provide proper retention for the fragile terminals. It has been found with the invention that a tail aligning device can be fixed to the housing and spaced from the rear face thereof to not only align the terminal tail portions but to allow the housing to be made thinner. Thick plastic housings tend to create irregular shrinkage problems when cured. Long terminal-receiving passages in thick housings are difficult to mold, and it is difficult to insert the terminals into long passages.

Another problem associated with such connectors is when the connectors and, particularly, the tail portions of the terminals are surface-mounted on the printed circuit board rather than inserted into holes in the board. Surface mount terminal tails include bent or angled "feet" portions for solder-connection to flat pads on the circuit board. When the feet are bent or formed at an angle to the tail portions, the tail portions may bow unnecessarily and can even become deformed. It has been found by the invention that a properly positioned tail aligning device can also aid in preventing unnecessary bowing of the terminal tails during formation of the surface mounting feet thereof.

The present invention is directed to providing a tail aligning device which helps solve the various problems outlined above.

SUMMARY OF THE INVENTION

An object, therefore, of the invention is to provide a new and improved electrical connector for mounting on a surface of a printed circuit board and which includes a tail aligning device.

In the exemplary embodiment of the invention, the connector includes an elongated dielectric housing having a central body portion with a front mating face, a lower face and a plurality of terminal-receiving passages extending therebetween. A plurality of terminals are received in the passages. Each terminal includes a forward contact portion and a tail portion projecting from the body portion beyond the lower face thereof. The tail portions include right-angled end portions or "feet" for surface mounting on the printed circuit board. An elongated tail aligner is fixed to the housing spaced from the lower face thereof. The tail aligner has a plurality of apertures through which the tail portions of the terminals extend.

As disclosed herein, the elongated tail aligner is located on the tail portions of the terminals spaced from the right-angled end portions thereof. The tail aligner is spaced from the lower face of the housing a distance at least equal to a thickness of the tail aligner. Two rows of the terminals have tail portions extending through a corresponding pair of rows of apertures in the tail aligner.

According to further aspects of the invention, the connector housing includes a pair of board mounting portions at opposite ends of the body portion and between which the tail aligner extends. The board mounting portions project past the lower face of the body portion. Each board mounting portion includes a board mounting face generally flush with the right-angled end portions of the terminals and an inside face to which one end of the elongated tail aligner is fixed. The tail aligner is fixed in recesses in the inside faces of the board mounting portions of the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
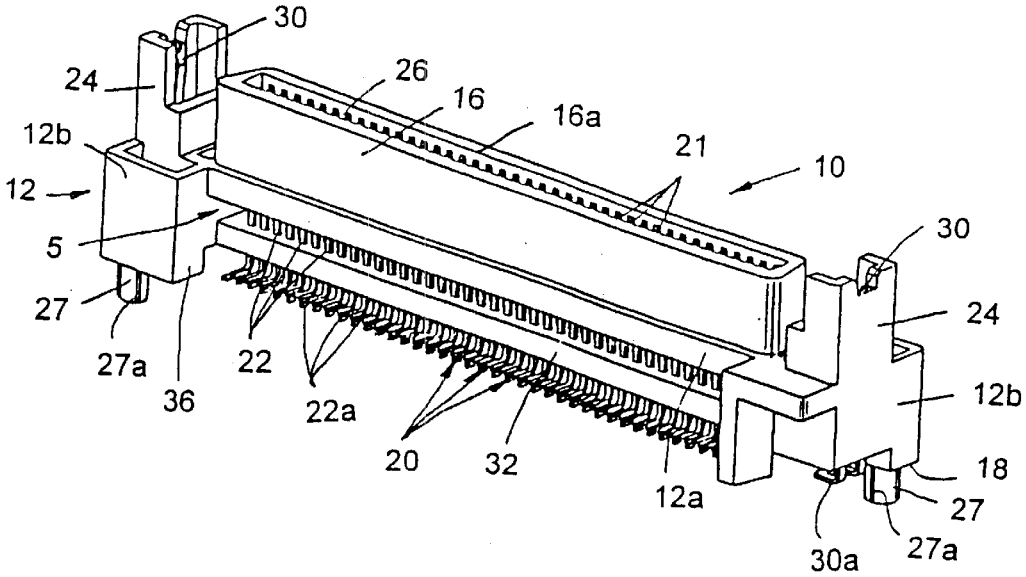
FIG. 1 is a top perspective view of an electrical connector embodying the concepts of the invention.
Figure 2:
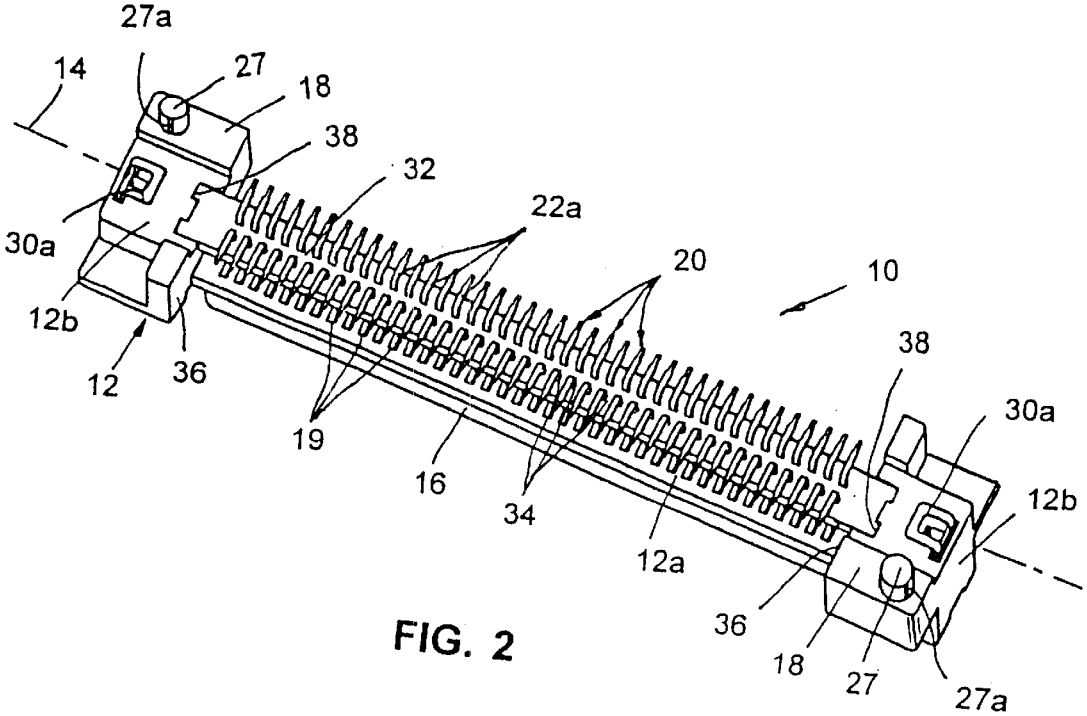
FIG. 2 is a bottom perspective view of the connector of FIG. 1.
Figure 3:
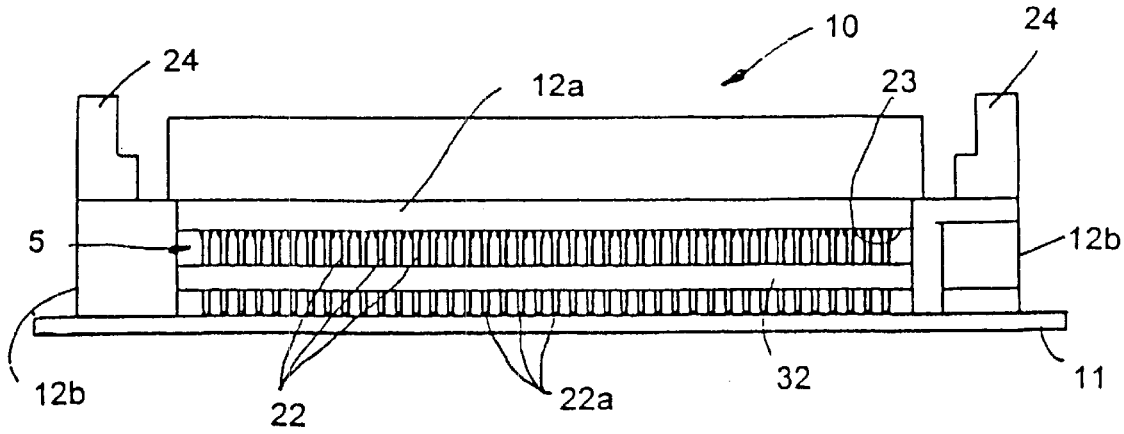
FIG. 3 is a side elevational view of the connector mounted on a surface of a printed circuit board.

Referring to the drawings in greater detail, and first to FIGS. 1 and 2, an electrical connector, generally designated 10, is designed for mounting on a surface of a printed circuit board 11 (FIG. 3). The connector includes a one-piece dielectric housing, generally designated 12, which can be unitarily molded of dielectric material such as plastic or the like. The housing is elongated and defines a longitudinal center line 14 (FIG. 2). The housing has an elongated central body portion 12*a* which extends between a pair of board-mounting end portions 12*b*. The housing further has a mating portion 16 defining a front mating face 16*a* opposite a board-mounting face 18. A plurality of terminal-receiving passages 19 (FIG. 2) mount a plurality of terminals, generally designated 20, in two rows. The terminals have contact portions 21 inside opposite side walls of mating portion 16. The terminals have tail portions 22 (FIG. 1) which project rearwardly from body portion 12*a* beyond a lower face 23 of the body portion. Tail portions 22 terminate in right-angled end portions 22*a* for surface mounting on printed circuit board 11.

Still further, housing 12 includes a pair of wing portions 24 projecting upwardly from board mounting portions 12*b* and spaced outside opposite ends of mating portion 16 and between which a complementary mating connector (not shown) is inserted. The mating connector will have a receptacle for receiving mating portion 16, along with a tongue for insertion into an elongated slot 26 (FIG. 1) within mating portion 16. Appropriate terminals of the mating connector will have contact portions on opposite sides of the tongue for engaging contact portions 21 inside the side walls of mating portion 16.

Housing 12 of connector 10 includes a pair of integrally molded members or mounting pegs 27 which project from mating face 18 of the housing. The pegs have small, longitudinal ribs 27*a* which can be crushed when inserted into mounting holes in circuit board 11 to provide a tight interference fit between the pegs and the holes. As seen best in FIG. 2, one of the pair of mounting pegs 26 is disposed on each opposite end of the longitudinal housing and on each opposite side of center line 14.

Connector 10 also includes an electrostatic discharge clip 30 (FIG. 1) mounted within each wing 24 at each end of the housing. The electrostatic discharge clip is of metal material and is located for engaging appropriate grounding contacts on the mating connector. The electrostatic discharge clips extend downwardly through the housing and terminate in U-shaped feet 30*a* for surface connection to appropriate grounding pads on the circuit board, as by soldering. Therefore, the electrostatic discharge clips perform an additional function of acting as "fitting nails" to hold the connector to the circuit board.

An elongated tail aligner 32 includes a plurality of apertures 34 through which tail portions 22 of the terminals extend, so that the aligner maintains proper spacing or pitch for the terminals. The tail aligner extends between inside faces 36 of board mounting portions 12*a* of the housing. Opposite ends of the tail aligner are fixed within recesses 38 in inside faces 36. The tail aligner can be fixed by a press or interference fit within the recesses, or by an appropriate adhesive or by sonic welding of the plastic material of the housing and the tail aligner.

As best shown in FIGS. 1 and 3, tail aligner 32 is spaced from rear face 23 of body portion 12*a* of the housing, as indicated at "S". In the illustrated embodiment, the tail aligner is spaced from the lower face of the body portion a distance at least equal to the thickness of the tail aligner. It can be seen that the tail aligner also is spaced from the right-angled surface mount feet 22*a* of tail portions 22 of the terminals. Without the tail aligner in place, when the feet of the terminals are bent during a forming operation, tail portions 22 may tend to unnecessarily bow or become deformed. Tail aligner 30 is positioned intermediate opposite ends of the freely projecting tail portions and prevents such bowing or deformation. The tail aligner also allows for body portion 12*a* of housing 12 to be made as thin as possible. Without the tail aligner, the housing would have to be considerably thicker to maintain proper spacing or pitch for the terminal tail portions. This requires rather lengthy passages 19 through the housing body. As stated in the "Background," above, with the ever-increasing miniaturization of electronic circuitry, including connectors such as connector 10, it not only becomes more difficult to mold long passages or holes in the plastic body for receiving the terminal tails, but it also becomes very difficult to insert the tails continuously through such long passages or holes. By providing tail aligner 32 and spacing the tail aligner from the housing body and fixing the tail aligner to the housing, these problems also are eliminated.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for mounting on a surface of a printed circuit board, comprising:

an elongated dielectric housing for mounting directly to the surface of the printed circuit board, the housing having a central body portion with a front mating face, a lower face extending along a plane generally parallel to said surface of said printed circuit board and a plurality of terminal-receiving passages extending therebetween;

a plurality of terminals received in respective ones of said passages, each terminal including a forward contact portion and a tail portion projecting rearwardly from the body portion beyond said lower face thereof; the tail portions including right-angled end portions for surface mounting on the printed circuit board; and an elongated tail aligner fixed to the housing spaced from said lower face thereof, the tail aligner having a plurality of apertures through which the tail portions of the terminals extend, the tail aligner being spaced apart from the printed circuit board.

2. The electrical connector of claim 1 wherein said tail aligner is located on the tail portions of the terminals spaced from the right-angled end portions thereof.

3. The electrical connector of claim 1 wherein said elongated tail aligner is spaced from the lower face of the housing a distance at least equal to a thickness of the tail aligner.

4. The electrical connector of claim 1, including two rows of said terminals having tail portions extending through a corresponding pair of rows of apertures in the tail aligner.

5. The electrical connector of claim 1 wherein said housing includes a pair of board mounting portions at opposite ends of the body portion and between which the tail aligner extends.

6. The electrical connector of claim 5 wherein said board mounting portions of the housing project past the lower face of the body portion, each board mounting portion including a board mounting face generally flush with the right-angled end portions of the terminals and on inside face to which one end of the elongated tail aligner is fixed.

7. The electrical connector of claim 6 wherein opposite ends of said elongated tail aligner are fixed in recesses in the inside faces of said board mounting portions of the housing.

8. An electrical connector for mounting on a surface of a printed circuit board, comprising:

an elongated dielectric housing having a central body portion with a front mating face, a lower face and at least two rows of terminal-receiving passages extending therebetween, and a pair of board mounting portions at opposite ends of the body portions, the board mounting portions projecting rearwardly of the lower face of the body portion, each board mounting portion including a board mounting face and an inside face;

at least two rows of terminals received in respective ones of said at least two rows of passages, each terminal including a forward contact portion and a tail portion projecting from the body portion beyond said lower face thereof, the tail portions including right-angled end portions generally coplanar with the board mounting faces of said board mounting portions of the housing for surface mounting on the printed circuit board; and an elongated tail aligner fixed to the housing and extending between the inside faces of the board mounting portions of the housing, the tail aligner being spaced from the lower face of the body portion and spaced from the right-angled end portions of the terminals, and the tail aligner having a plurality of apertures through which the tail portions of the terminals extend.

9. The electrical connector of claim 8 wherein said elongated tail aligner is spaced from the lower face of the housing a distance at least equal to a thickness of the tail aligner.

10. The electrical connector of claim 8 wherein opposite ends of said elongated tail aligner are fixed in recesses in the inside faces of said board mounting portions of the housing.

11. An electrical connector for mounting on a surface of a printed circuit board, comprising:

a dielectric housing having a body portion with a lower face;

a plurality of terminals disposed in the housing and having tail portions projecting rearwardly beyond said lower face, the tail portions having angled sections for surface mounting on the printed circuit board; and a tail aligner fixed to the housing in a spaced relationship from said lower face, the tail aligner having a plurality of apertures through which the tail portions of the terminals extend, the tail aligner being spaced from the lower face of the housing at a distance at least equal to a thickness of the tail aligner.

12. The electrical connector of claim 11 wherein said tail aligner is located on the tail portions of the terminals spaced from the angled sections thereof.

13. The electrical connector of claim 11, including two rows of said terminals having tail portions extending through a corresponding pair of rows of apertures in the tail aligner.

14. The electrical connector of claim 11 wherein said housing includes a pair of board mounting portions at opposite ends of the body portion and between which the tail aligner extends.

15. The electrical connector of claim 14 wherein said board mounting portions of the housing project past the lower face of the body portion, each board mounting portion including a board mounting face generally flush with the angled sections of the terminals and on inside face to which one end of the elongated tail aligner is fixed.

16. The electrical connector of claim 15 wherein opposite ends of said elongated tail aligner are fixed in recesses in the inside faces of said board mounting portions of the housing.

* * * * *